US008646515B2

(12) United States Patent
Collins, III et al.

(10) Patent No.: US 8,646,515 B2
(45) Date of Patent: Feb. 11, 2014

(54) CERAMIC FERRULES AND CERAMIC FERRULE ARRAY INCLUDING SAME FOR TUBE PITCH VARIABILITY TOLERANT PROCESS HEAT BOILER SYSTEM

(75) Inventors: Edwin L. Collins, III, Albany, NY (US); Jeffrey J. Bolebruch, Amsterdam, NY (US)

(73) Assignee: Blasch Precision Ceramics, Inc., Albany, NY (US)

( * ) Notice: Subject to any disclaimer, the term of this patent is extended or adjusted under 35 U.S.C. 154(b) by 712 days.

(21) Appl. No.: 12/846,939

(22) Filed: Jul. 30, 2010

(65) Prior Publication Data

US 2011/0024094 A1 Feb. 3, 2011

Related U.S. Application Data

(60) Provisional application No. 61/230,243, filed on Jul. 31, 2009.

(51) Int. Cl.
*F28F 19/00* (2006.01)
*F28F 13/00* (2006.01)

(52) U.S. Cl.
USPC ..... 165/134.1; 165/135

(58) Field of Classification Search
USPC ..... 165/134.1, 135, 910; 122/511
See application file for complete search history.

(56) References Cited

U.S. PATENT DOCUMENTS

| | | | | |
|---|---|---|---|---|
| 953,062 | A * | 3/1910 | Schmitt | 285/41 |
| 1,046,132 | A * | 12/1912 | Winslow | 122/114 |
| 1,427,318 | A * | 8/1922 | Payne | 165/173 |
| 5,647,432 | A * | 7/1997 | Rexford et al. | 165/134.1 |
| 2005/0016721 | A1 * | 1/2005 | Antonijevic et al. | 165/177 |
| 2008/0290721 | A1 * | 11/2008 | Wang | 301/58 |

OTHER PUBLICATIONS

Applicant's disclosed prior art shown in Fig. 1A.*

* cited by examiner

*Primary Examiner* — Brandon M Rosati
*Assistant Examiner* — Jon T Schermerhorn
(74) *Attorney, Agent, or Firm* — Burr & Brown, PLLC

(57) ABSTRACT

A cover ferrule is provided, including a hexagonally shaped head portion, a joint shield portion provided at an upper surface of the head portion, and a stein portion extending downwardly from a first end proximate a lower surface of the head portion to an opposed second end thereof. The joint shield portion includes a central opening, coaxially aligned with respect to central openings of the head and stem portions and with a central axis of the cover ferrule, and a plurality of extension members extending radially outwardly with respect to the central axis of the cover ferrule and defining arc portions connecting respectively adjacent extension members of the joint shield portion.

4 Claims, 12 Drawing Sheets

CERAMIC FERRULES AND CERAMIC FERRULE ARRAY INCLUDING SAME FOR TUBE PITCH VARIABILITY TOLERANT PROCESS HEAT BOILER SYSTEM

CROSS-REFERENCE TO RELATED APPLICATION

This application claims priority from U.S. Application Ser. No. 61/230,243, filed Jul. 31, 2009, the entirety of which is incorporated herein by reference.

FIELD OF THE INVENTION

The present invention relates, in general, to ceramic ferrules used in tubesheet arrays of process heat boilers, and in particular, to a novel combination of inventive ceramic hexagonal ferrules and ceramic cover ferrules used in a ferrule array to accommodate for variations in tube pitch in the tube sheet.

BACKGROUND OF THE INVENTION

Process heat boilers are commonly used with many types of industrial heat sources to extract heat from process gases of an industrial process. It may be necessary to extract heat from the process gas to cause a component thereof to condense, or it may be advantageous to extract heat from the process gas and use that heat in another process or even to provide heat for the industrial facility.

Generally speaking, a process heat boiler includes a plurality of metal boiler tubes supported by opposed metal tube sheets. The tube sheets define a vessel for holding water or some other form of heat transfer medium. Hot process gas passes through the boiler tubes arranged in the inlet tube sheet and heat is extracted therefrom via heat transfer from the hot gas to the water contained within the confines of the tube sheets. In higher temperature applications this type of process heat boiler requires a refractory face on the tubesheet exposed to the high temperatures. The current technology for providing this refractory face (hotface) is to employ ceramic hexagonal (hex) or square head ferrules (see, e.g., U.S. Pat. No. 5,647,432, owned by Blasch Precision Ceramics, Inc.).

With the current ceramic hex ferrule or square head ferrule technology, the outer shape of the head portion of the ferrule enables the mating of a plurality of adjacent ferrules in an array to cooperatively form a substantially gas-tight refractory barrier wall. The outer peripheral dimension of each ferrule is selected such that the ferrules are separated from one another when the industrial heat source is inoperative, and are abutted/mated at respective outer peripheral surfaces when the industrial heat source is operative, whereby a substantially gas-tight seal is formed between the entirety of respective outer peripheral surfaces of adjacent ferrules. The head portions of the ferrules have sufficient axial length to perform the function of the castable refractory wall, that is, to shield the inlet tube sheet from the process gas. The tube portions of the ferrules shield the inlet ends of the boiler tubes.

FIGS. 1A to 1C show a current technology ceramic hex ferrule 300 to be installed in a tube sheet 41 in connection with a process heat boiler, where FIG. 1C clearly shows the head gasket material 350 wrapped in the peripheral head groove 311. FIG. 1D shows a complete tubesheet array 40 including current technology ceramic hex ferrules 300 installed in the openings 42 of the tubesheet 41 to define the array.

The current ceramic hex ferrule 300, or square head ferrule technology, has proven to work well in most applications due, in large part, to the expansion gap provided between the individual adjacent ferrule heads, which eliminates mechanical loading on the heads due to accumulated thermal expansion across the tubesheet, and provides effective containment of the head gasket material seated in the recess area along the head periphery.

For example, as shown in FIGS. 1A and 1B, the standard hex ferrule 300 includes a hexagonally shaped head portion 301 and a substantially cylindrical stem portion 320 extending therefrom. The stem portion 320 also includes a tapered portion 322 located proximate the end thereof closest to the head portion 301, which transitions to the cylindrical part 324 at transition point 325.

The head portion 301 includes an upper surface 302 that includes a tapered (radiused) portion 304 curving downwardly from the peripheral edge of the opening 308 toward the outer peripheral edge of the upper surface 302. The tapered portion 304 of the upper surface 302 of the head portion 301 of the hex ferule 300 serves to reduce disruption and detachment of gas flow thereby reducing the overall pressure loss.

The head portion 301 of the hex ferrule 300 also includes a central annular recess 311 in the outer surface 307 thereof, which is suitable for the provision of gasket material 350, such as fiber wrap therein (as shown in FIG. 1C).

However, this technology can be problematic in situations where the tubesheet to be protected exhibits a high variability in the tube to tube pitch (e.g., tube center to tube center distances). This can be seen in older tubesheets that were not originally manufactured to the close tolerances that are standard today, or it can occur on tubesheets that have experienced some degree of maintenance and repair. This high variability (i.e., >0.03") can be troublesome with respect to the installation of precision ceramic ferrules, where the gap for thermal expansion between the ferrule heads is small, ranging, depending on boiler design and temperature, from 0.020" to over 0.060", for example. In some instances, the ferrules need to be cut to fit. In other instances, the gap for thermal expansion may be too small, causing stress and reliability concerns.

In order to accommodate for excessive variability of tube to tube pitch in a tubesheet, it is necessary to increase the design gap between each ferrule head at assembly. This is accomplished by reducing the flat to flat distance across each individual ferrule head. The flat to flat distance is understood to be the distance between any pair of edges of the hexagonally shaped head portion on a single ferrule. An example of this type of array 410 including slightly modified hex ferrules 300A can be seen in FIG. 2. The hex ferrules 300A have essentially the same structures as the hex ferrules 300, with the exception that the size of the hexagonally shaped head portions are slightly smaller so as to reduce the overall flat to flat distance, as discussed above. Other aspects of the hex ferrules 300A remain consistent with those described in connection with the hex ferrules 300, and repeat descriptions are omitted. The hex ferrules 300A also include gasket material in the annular recess thereof in the same manner as shown in FIG. 1C, for example.

As shown in FIG. 2, the array 410 includes a tubesheet 411 having an irregular pitch between the openings 412 therein, and the hex ferrules 300A installed therein provide additional gaps between adjacent head portions to accommodate thermal expansion and variability in tube to tube pitch. FIG. 3 depicts a partial sectional view of some of these ferrules 300A showing the additional gap at the hot face (top of the ferrule)

in relation to the head recessed area that will contain the head gasket material. However, a problem arises in that this additional gap needed to accommodate for the thermal expansion variability also leaves a larger path for process gas to impinge on the head gasket material and can provide an avenue for gasket material to slide out from between the heads.

SUMMARY OF THE INVENTION

It is an object of the present invention to provide a design that accommodates variability in tubesheet tube to tube pitch, while preserving the function of the expansion gap between the ferrules and sufficiently containing the head gasket material, such as wrap fiber.

In the present invention, the excessive hotface gap between adjacent ferrules in variable tube pitch tubesheet arrays is contained using a combination of a first type of inventive hex ferrule (shown, e.g., in FIGS. 4 and 5) in conjunction with a second type of inventive ferrule, hereinafter referred to as a cover ferrule. The cover ferrule (shown, e.g., in FIGS. 6 and 7), has an extended head compared to that of the hex ferrule shown in FIGS. 4 and 5. This extended-length head also includes a joint shield portion that extends radially outward with respect to a central longitudinal axis of the cover ferrule, so as to partially cover the hotface gap of each adjacent hex ferrule and to provide a smooth conical transition for gas flow therein and into the adjacent hex ferrules.

For any given installation array, one cover ferrule is required for every two hex ferrules. The combination of all the installed cover ferrules will cover the majority of the open head gap, thereby eliminating direct impingement of process gas on the gap and effectively containing the head gasket material. For example, as described in more detail below, the ferrule array shown in FIGS. 8 and 9 include 14 inventive hex ferrules and 7 cover ferrules. FIGS. 8 and 9 illustrate that the additional head gap between the hex ferrules is covered by the joint shield portions extensions of the adjacent cover ferrules, thereby effectively blocking direct process gas impingement and containing the head gasket material without impeding thermal expansion of the ferrules.

According to a first aspect of the present invention, a cover ferrule is provided, comprising a head portion, a joint shield portion and a stem portion. The head portion includes a hexagonally shaped portion with a central opening, coaxially aligned with a central axis of the cover ferrule, passing therethrough and defining an inner space therein. The joint shield portion is provided at an upper surface of the head portion, and comprises a central opening, coaxially aligned with respect to the central opening of the head portion and the central axis of the cover ferrule, and a plurality of extension members extending radially outwardly with respect to the central axis of the cover ferrule and defining arcs connecting respectively adjacent extension members of the joint shield portion. The stem portion extends downwardly from a first end proximate a lower surface of the hexagonally shaped portion of the head portion to an opposed second end thereof, and includes a central opening therein defining an inner space that is continuous with respect to the inner space of the head portion.

Preferably, the joint shield portion includes a tapered surface extending from an outer peripheral edge of the central opening toward the central axis thereof. It is also preferred that the joint shield portion includes six extension members, and that the arcs connecting the adjacent extension members are each 120°. In addition, the extension members each preferably include a flat end face extending in a direction that is substantially perpendicular with respect to an upper surface of the joint shield portion and that is substantially parallel with respect to the central axis of the cover ferrule.

According to a second aspect of the present invention, a ferrule array is provided, including a combination of a plurality of first and second ferrules arranged in an array. Each of the first ferrules comprises a hexagonally shaped head portion having an upper surface including a flat portion circumscribing a central opening of the head portion, and a substantially cylindrical stem portion extending from a lower surface of the head portion and having a central opening therein, wherein the central openings of the head portion and the stem portion are coaxially aligned with respect to one another and a central axis of the first ferrules, to define a single continuous ferrule opening that passes through the first ferrule from an upper surface of the head portion to a lower surface of the stem portion thereof. Each of the second ferrules comprises a hexagonally shaped head portion, a substantially cylindrical stem portion extending from a lower surface of the head portion, and a central opening that is coaxially aligned with respect to a central axis of the second ferrules and passing continuously therethrough from a central opening in an upper surface of the head portion to a central opening in a lower surface of the stem portion, and a joint shield portion provided at an upper surface of the head portion. The joint shield portion comprises a central opening, coaxially aligned with respect to the central openings of the head portion and the stem portion and with respect to the central axis of the second ferrule, and a plurality of extension members extending radially outward with respect to the central axis of the second ferrule and defining arcs connecting respectively adjacent extensions. The plurality of second ferrules are arranged among the plurality of first ferrules in the array, and the number "n" of the plurality of second ferrules corresponds to a number "2n" of the plurality of first ferrules in the array. The lower surfaces of the extension members of the joint shield section of the second ferrules contact the flat portions of the upper surfaces of the head portions of the first ferrules so that the extension members overlap a portion of the upper surfaces of the respective head portions of the first ferrules in the array, whereby the arc portions of the extension members each circumscribe a portion of the central openings of the adjacent head portions of the first ferrules, and any gaps present between outer peripheral edges of respectively adjacent head portions of the first ferrules in the array are overlapped by the extension members.

Preferably, the extension members each comprise a flat end face extending in a direction that is substantially perpendicular with respect to an upper surface of the joint shield portion and that is substantially parallel with respect to the central axis of the second ferrule, whereby adjacent end faces of extension members from adjacent second ferrules in the array face one another, are separated only by a predetermined gap when the industrial heat source is inoperative (i.e., an inoperative state of the array), and to abut one another in a gas-tight manner in operative state of the array.

BRIEF DESCRIPTION OF THE DRAWINGS

For a better understanding of the present invention, reference should be made to the following detailed description of a preferred embodiment, read in connection with the accompanying drawings, in which.

DETAILED DESCRIPTION OF THE INVENTION

Figure 4:
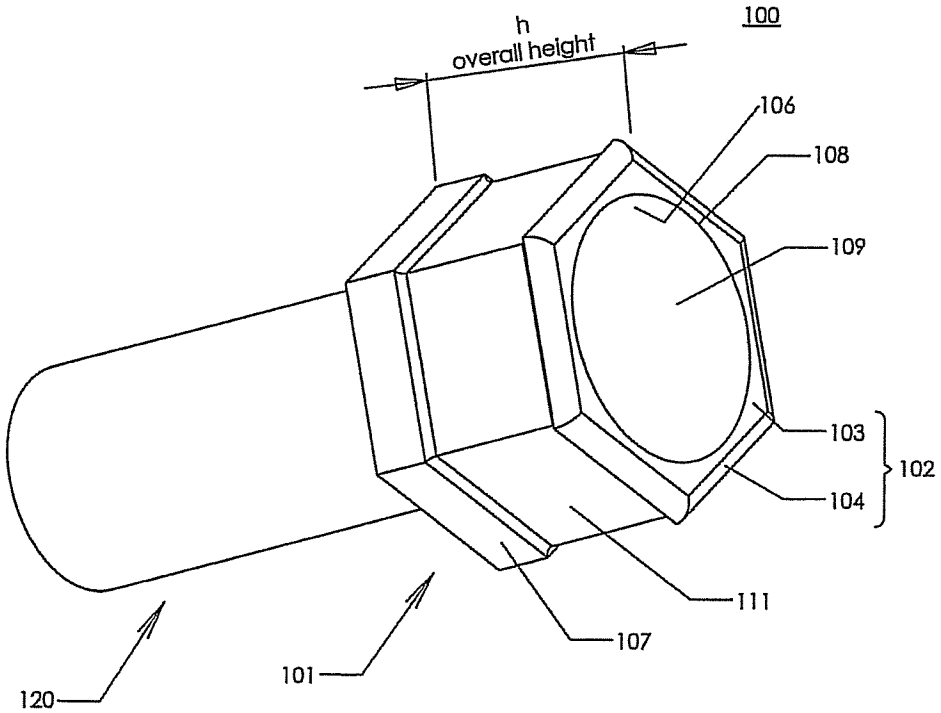
FIG. 4 is a perspective top view of a hex ferrule 100 according to one aspect of the present invention.
Figure 5:
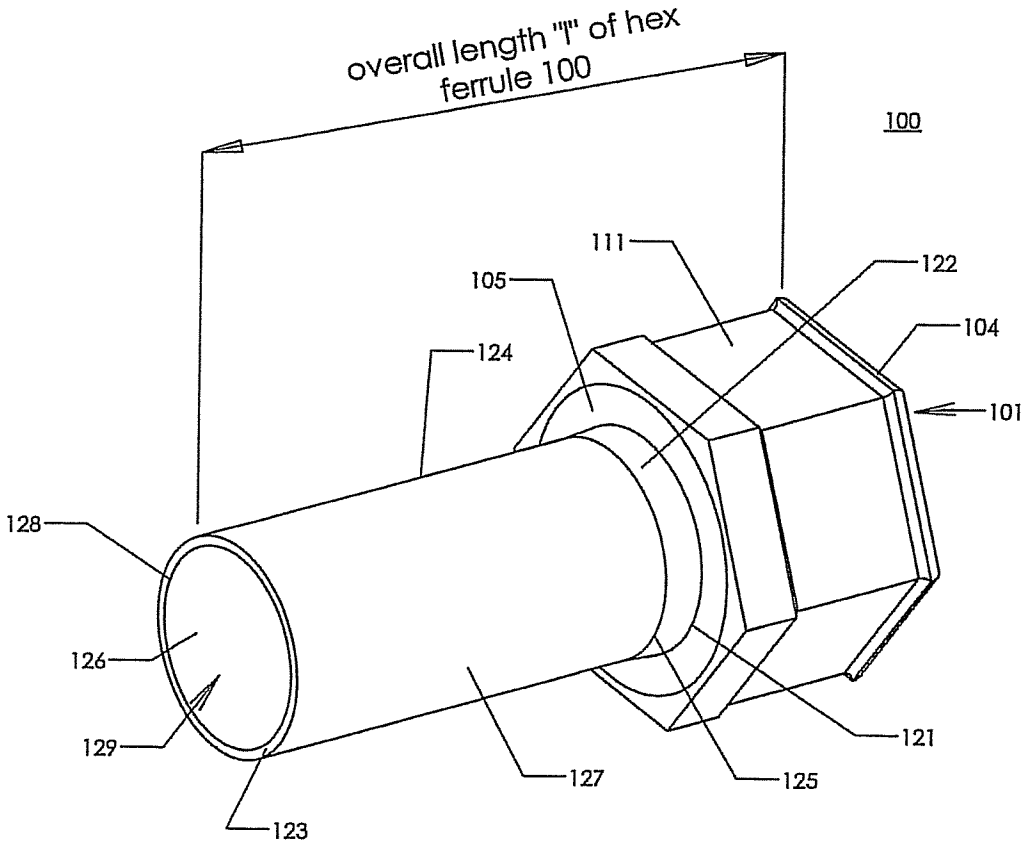
FIG. 5 is a perspective bottom view of the hex ferrule 100 shown in FIG. 4.

FIG. 4 is a perspective top view of a hex ferrule 100 according to one aspect of the present invention, and FIG. 5 is a perspective bottom view of the hex ferrule 100 shown in FIG. 4. The hex ferrule 100 is similar to that of the standard hex ferrule 300 described above, but includes two significant structural modifications, discussed in more detail below.

The hex ferrule 100 includes a hexagonally shaped head portion 101 and a substantially cylindrical stein portion 120 extending therefrom. As shown in FIG. 5 and in the partial sectional view portions of FIGS. 8 and 9, the stem portion 120 also includes a tapered portion 122 located proximate the first end 121 thereof, which transitions to the cylindrical part 124 at transition point 125.

Figure 8:
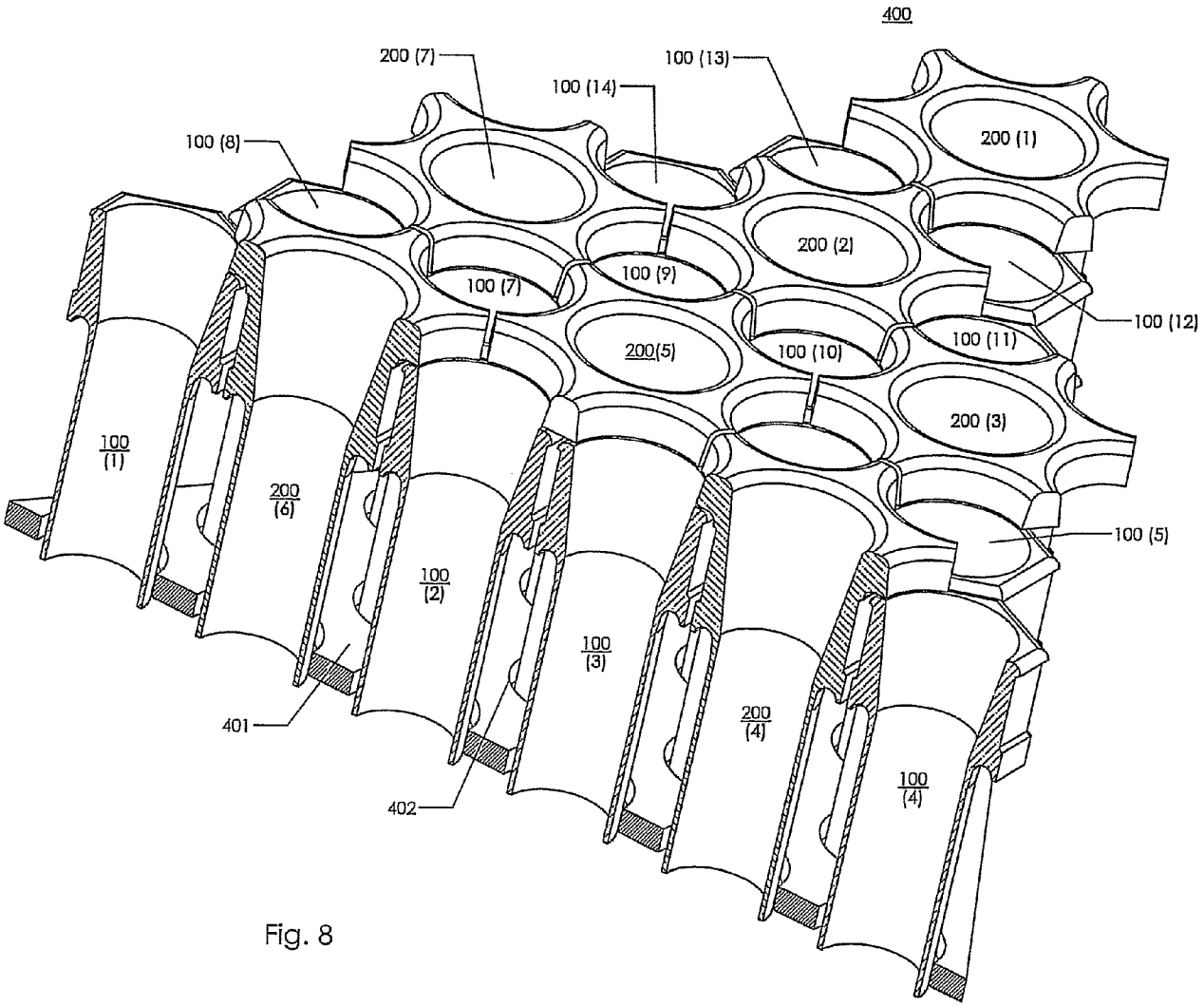
FIG. 8 is a perspective, partial-sectional view of a ferrule array 400 including a plurality of hex ferrules 100 and cover ferrules 200.
Figure 9:
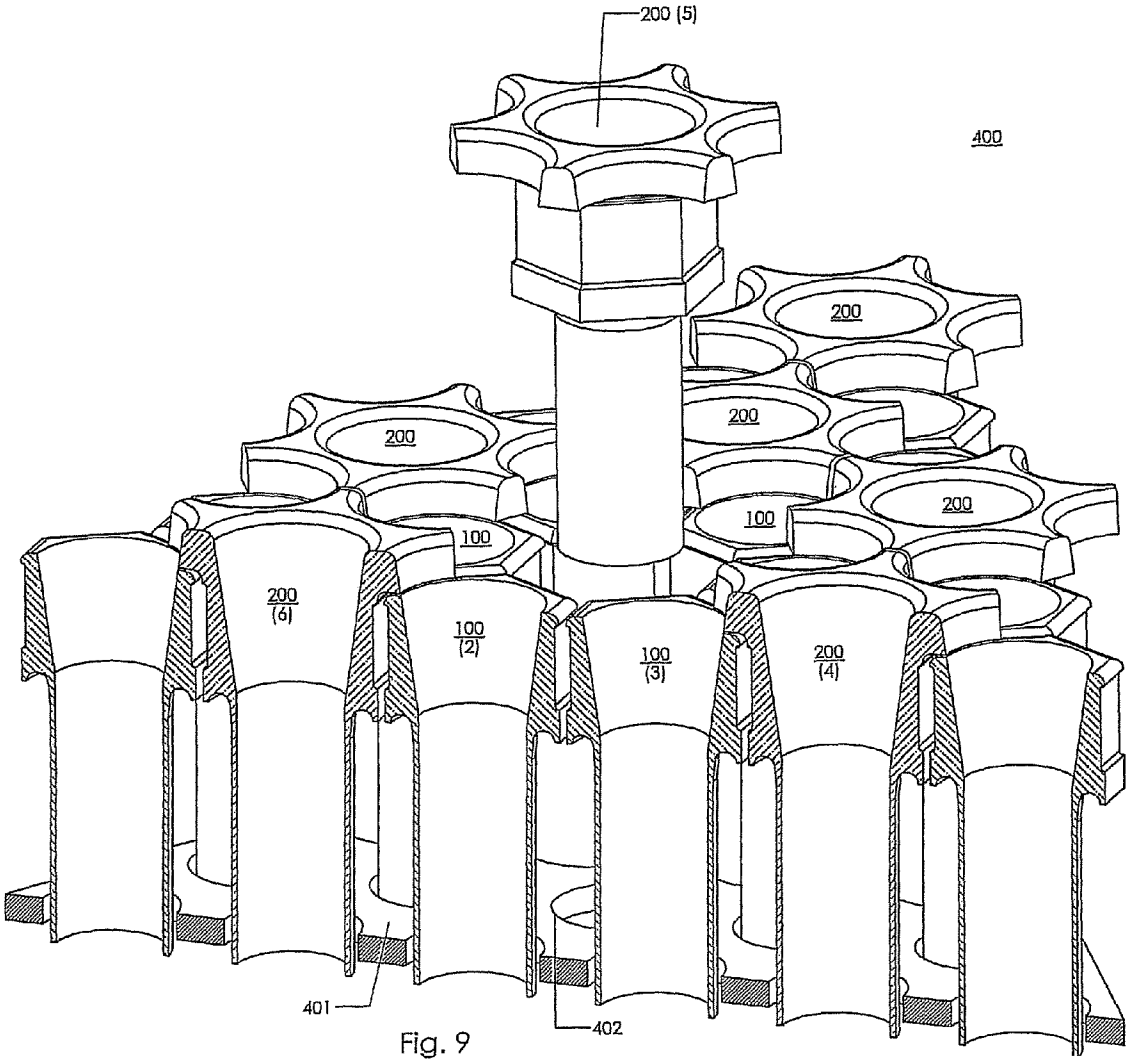
FIG. 9 is a perspective, partial-sectional view of the ferrule array in FIG. 8, wherein the cover ferrule 200(5) of FIG. 8 is shown in an elevated assembly position with respect to the surrounding hex ferrules 100(2), 100(3), 100(4), 100(6), 100 (10), 100(9) and 100(7).

The head portion 101 includes an upper surface 102 that includes a flat portion 103 immediately proximate the central opening 108, and a tapered (radiused) portion 104 curving downwardly from the terminal edge of the flat portion 103 toward the outer peripheral edge face of the upper surface 102. This structure of the inventive hex ferrule 100 differs from that of the standard hex ferrule 300 shown in FIGS. 1A-1C and the modified standard hex ferrules 300A shown in FIG. 2, for example, which do not include the flat portion 103. That is, in the present invention, the flat portion 103 is provided to ensure a uniform junction with respect to the flat surface lower surface 212 of the extension members 215 of the joint shield portion 210 of the cover ferrules 200 that rest thereon when an array 400 is assembled, as shown in FIGS. 8 and 9 and explained in more detail below.

The flat portion 103 of the upper surface 102 of the head portion 101 would, in fact, be undesirable in the context of a standard hex ferrule 300 for an array 40, the upper surfaces 302 of which are specifically designed to taper inward to aid in the directionality of the gas flow therethrough and into the ferrules of the tubesheet array. On the other hand, in the present invention, the upper surfaces 102 of the hex ferrules 100 are obscured by the cover ferrules 200 thereon, and as such, do not directly contact or guide the directionality of the gas flow into the tubesheet ferrule array 400.

The tapered portion 104 of the upper surface 102 of the head portion 101 of the hex ferule 100 serves to prevent disruption in gas flow and reduce overall pressure loss.

Figure 1A:
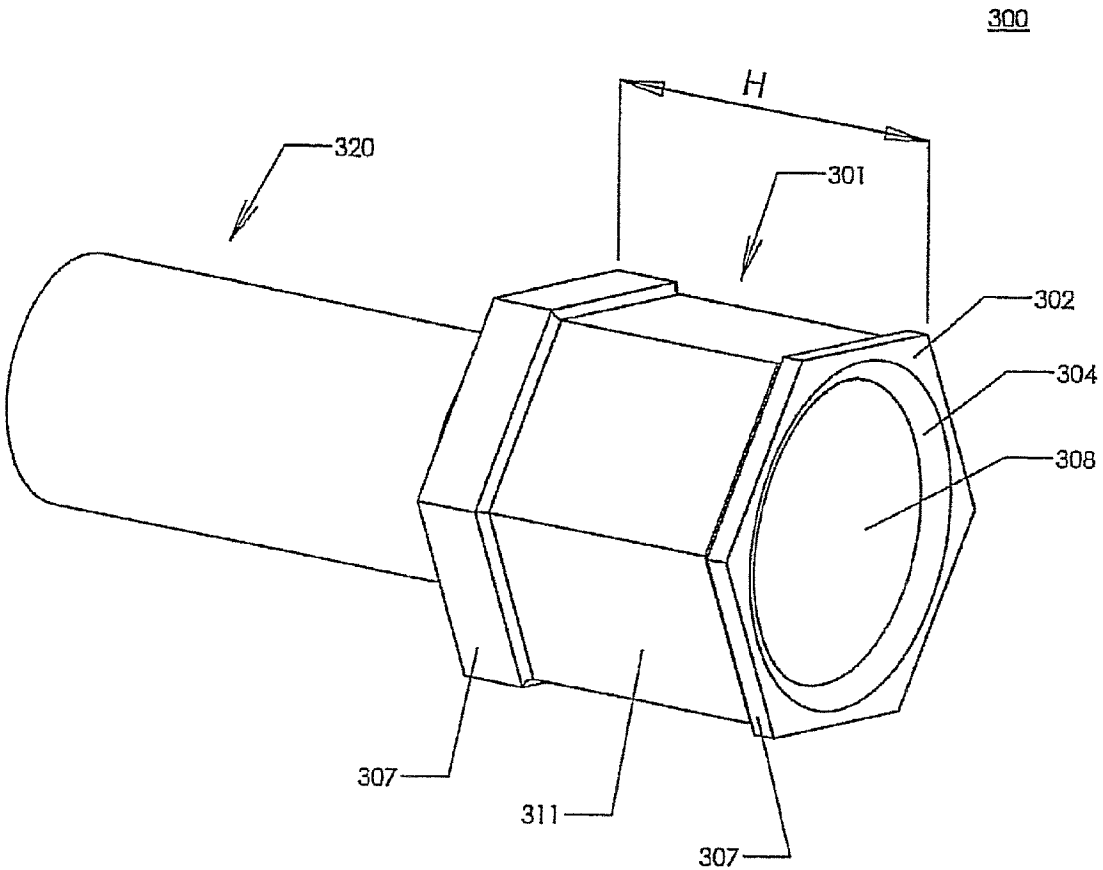
Fig. 1A PRIOR ART
FIGS. 1A-1C depict a standard hex ferrule 300 and FIG. 1D shows a portion of an array 40 including a tubesheet 41 and having the standard ceramic hex ferrules 300 installed in the openings 42 thereof to define the array.
Figure 1B:
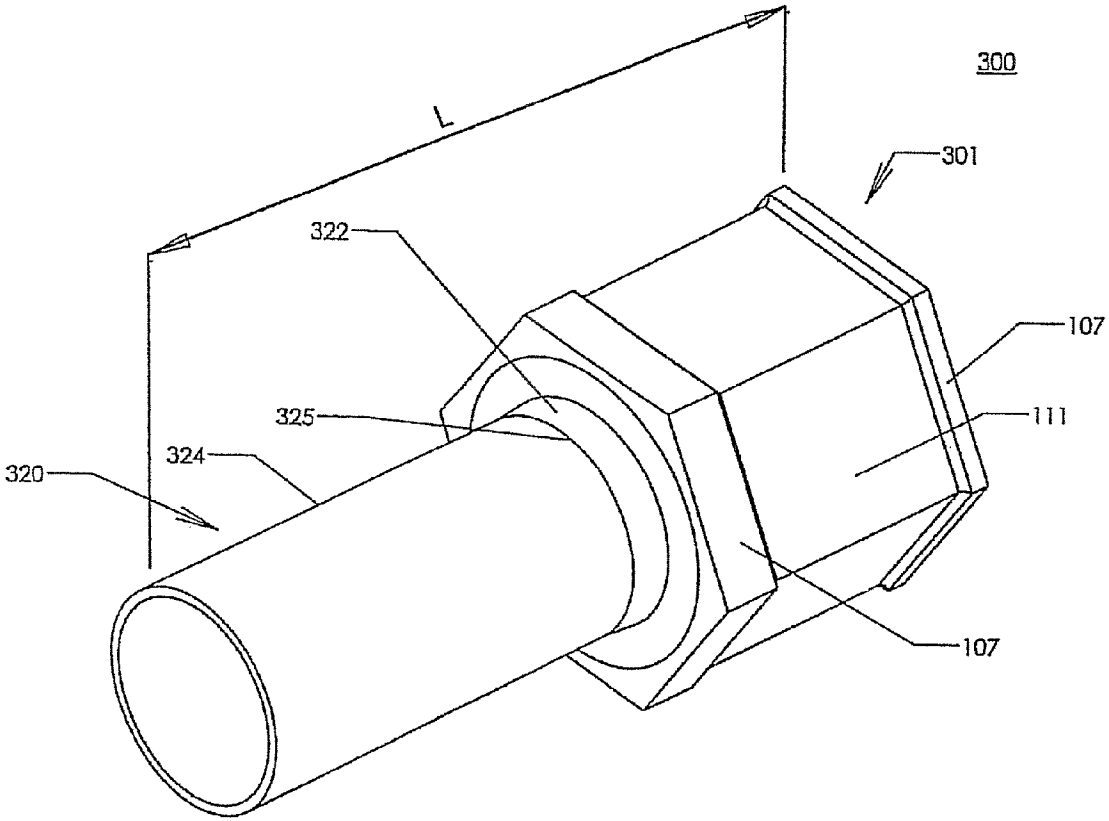
Fig. 1B PRIOR ART
Figure 2:
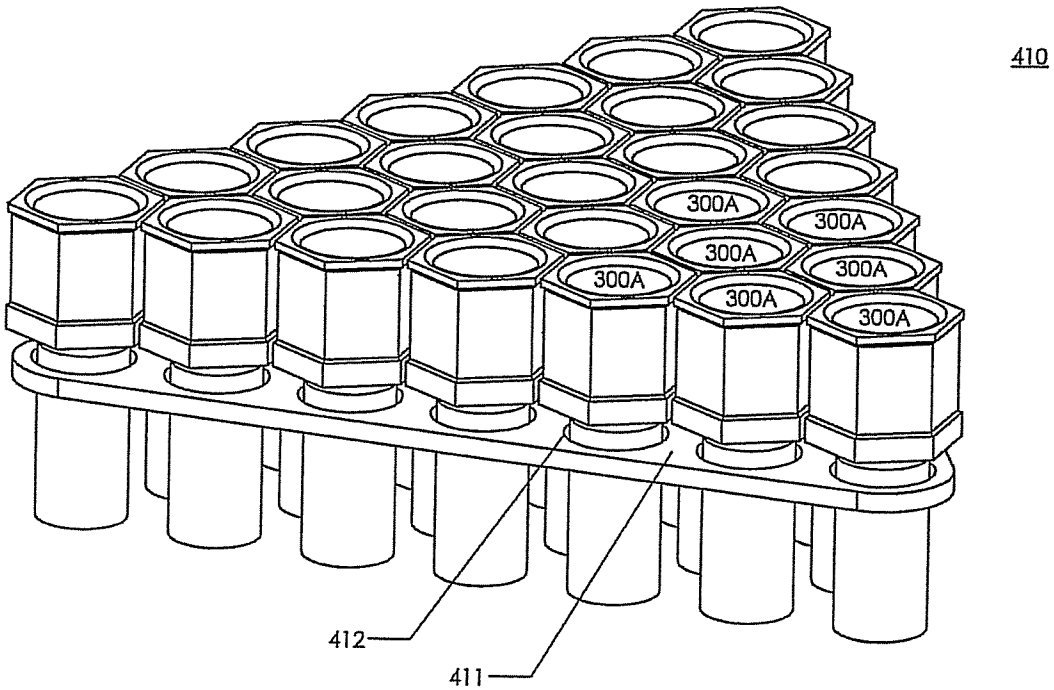
FIG. 2 is depicts a portion of an array 410 including a tubesheet 411 and having modified standard ceramic hex ferrules 300A installed in the irregularly pitched openings 412 thereof to define the array.
Figure 3:
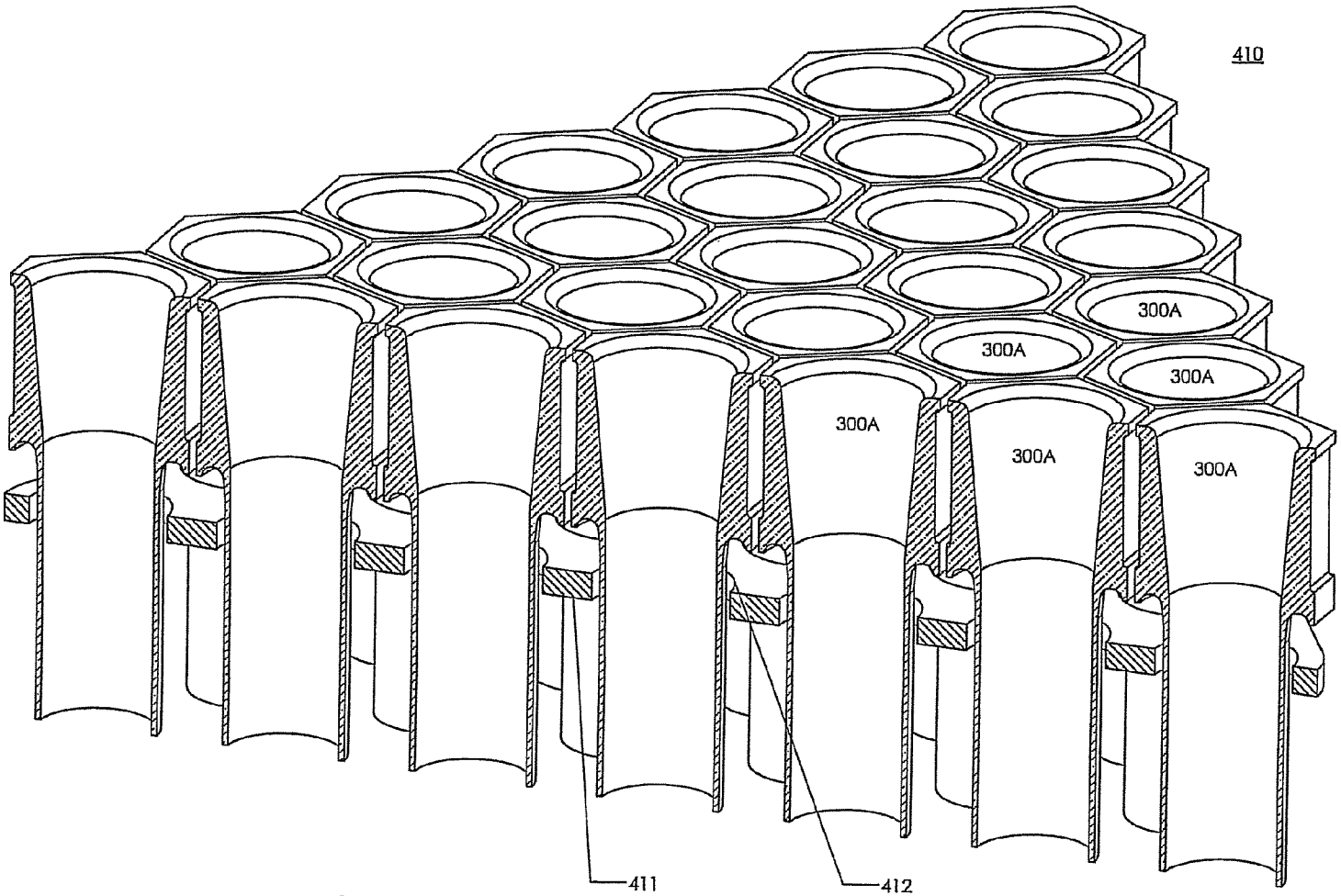
FIG. 3 is a partial sectional view showing the modified standard ferrules 300A in the array 410 and showing the additional gap at the hot face (top of the ferrule 300A)
Figure 6:
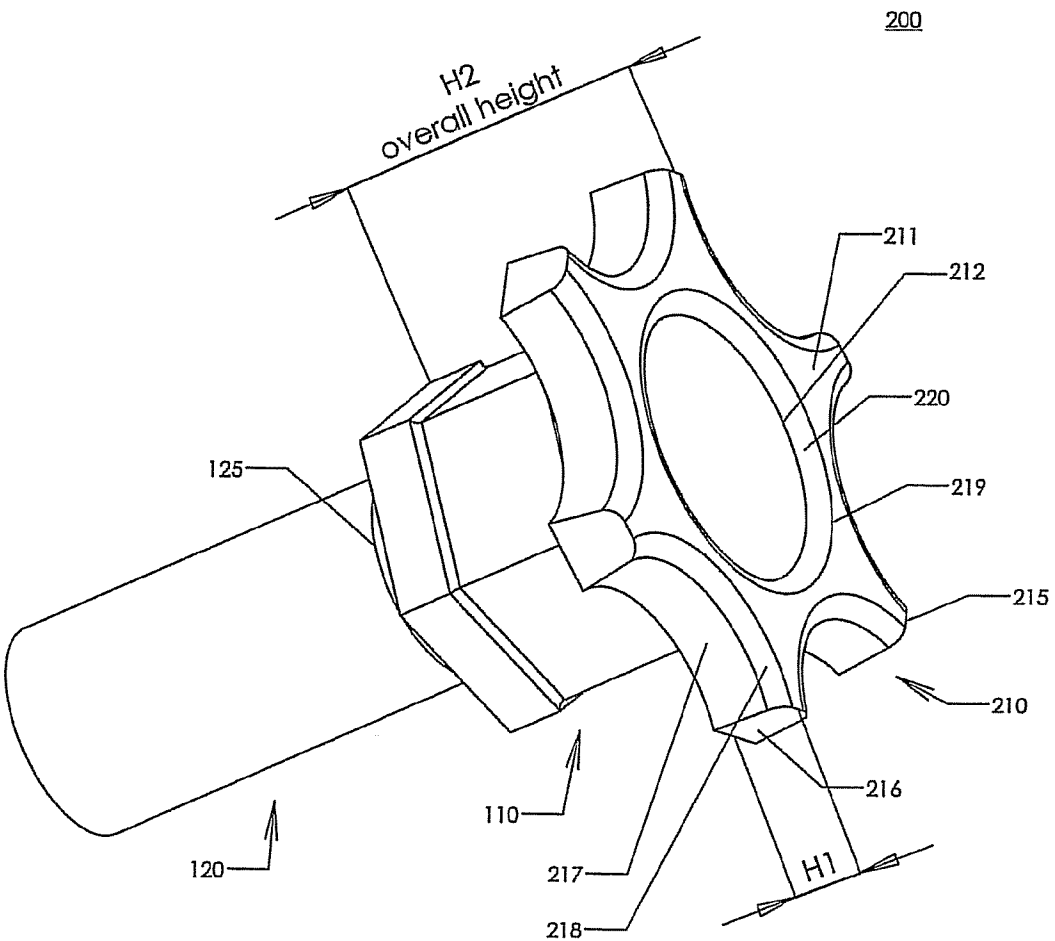
FIG. 6 is a perspective top view of a cover ferrule 200 according to one aspect of the present invention

Another important difference between the hex ferrules 100 according to the present invention and standard hex ferrules 300 is that the overall length "l" of the hex ferrule 100 shown in FIG. 5 is less than the overall length "L" of the standard hex ferrule 300 shown, e.g., in FIG. 1B, and the overall height "h" of the head portion 101 of the hex ferule 100 shown in FIG. 4 is reduced compared to the overall height "H" of the head portion 301 of the hex ferule 300 shown in FIG. 1A, for example. The reduced height "h" of the head portion 101 of the hex ferule 100 is designed to accommodate for the additional height "$H_1$" of the joint shield portions 210 of the cover ferrules 200 (described below in connection with FIGS. 6 and 7) thereon. The combined heights "h" and "$H_1$" define the overall height "$H_2$" of the head portion (including the joint shield portion 210) of the cover ferrule 200, as shown in FIG. 6. The overall height "$H_2$" is substantially the same as the overall height "H" of the head portion 301 of the standard hex ferrule 300. This relationship is provided to ensure that the overall length "$L_2$" of the cover ferrules 200 in the array 400 is substantially the same as the overall length "L" of the standard hex ferrules 300 in the array 40 (see, e.g., FIGS. 1B and 7).

Figure 1C:
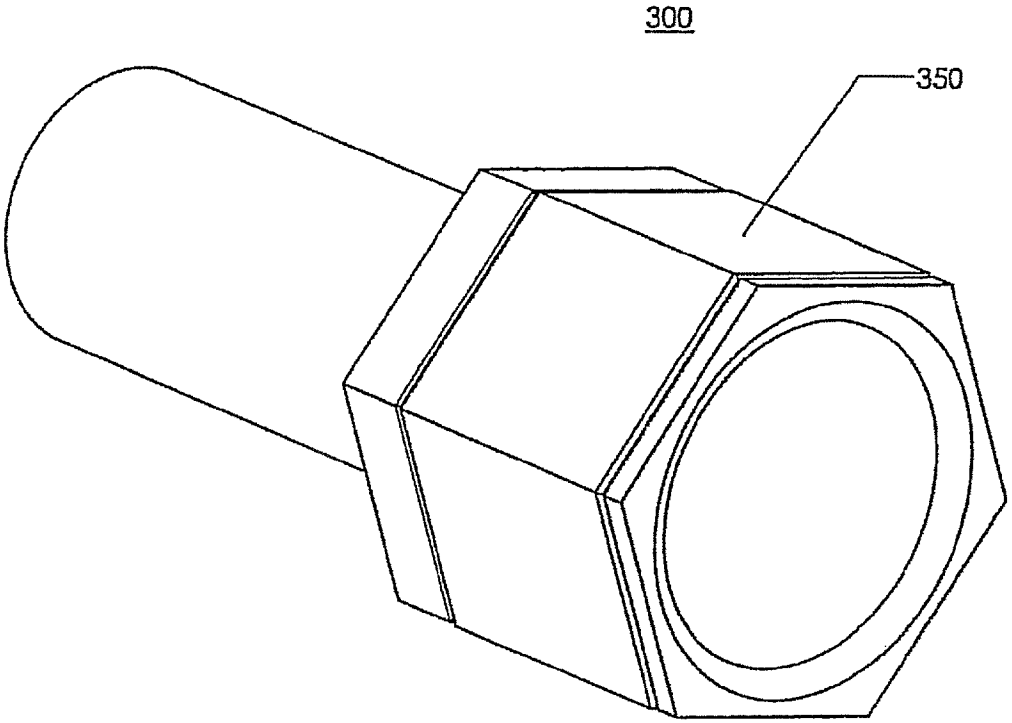
Fig. 1C PRIOR ART
Figure 1D:
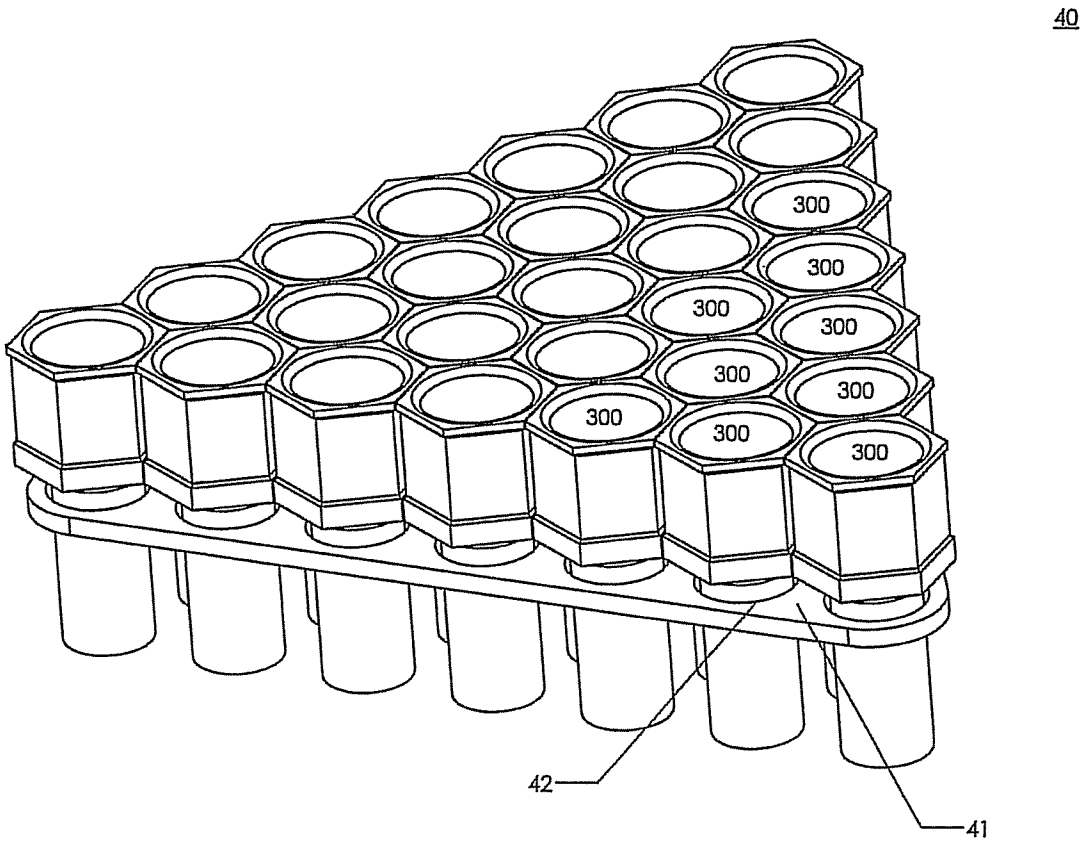

The head portion 101 of the hex ferrule 100 also includes a central annular recess 111 in the outer surface 107 thereof, which is suitable for the retention of gasket material, such as fiber wrap, therein, similar to the gasket material 350 described above in connection with standard hex ferrules 300 and which is shown in FIG. 1C.

The central opening 108 in the upper surface 102 of the head portion 101 of the hex ferule 100 communicates with the tapered inner space 109 thereof, which, in turn, continues in communication with the inner space 129 through the tapered portion 122 of the stem portion 120 and the cylindrical portion 124 of the stem portion 120 to the opening 128 at the second end 123 of the stem portion 120. The respective inner spaces thereby define inner surfaces which are contiguous since the hex ferrule 100 is either formed as a unitary member initially, or via a post-forming bonding method, such as adhesive bonding or sintering, as discussed in more detail below.

Suitable materials for forming the hex ferrule 100 according to the present invention include, but are not limited to, 95 wt % alumina, 99.7 wt % alumina, mullite and silicon carbide.

Suitable methods for forming the hex ferrule 100 according to the present invention include, but are not limited to, injection molding the entire hex ferrule 100 as a unitary member, casting the entire hex ferrule 100 as a unitary member and extrusion and machining to form a unitary member. It should also be noted that other suitable forming methods include casting, injection molding and extrusion and machining the head portion 101 and the stem portion 120 separately, and thereafter joining the respective portions by bonding using pre-fire or post-fire bonding adhesives, such as refractory cements, sintering, or other mortar materials.

Figure 7:
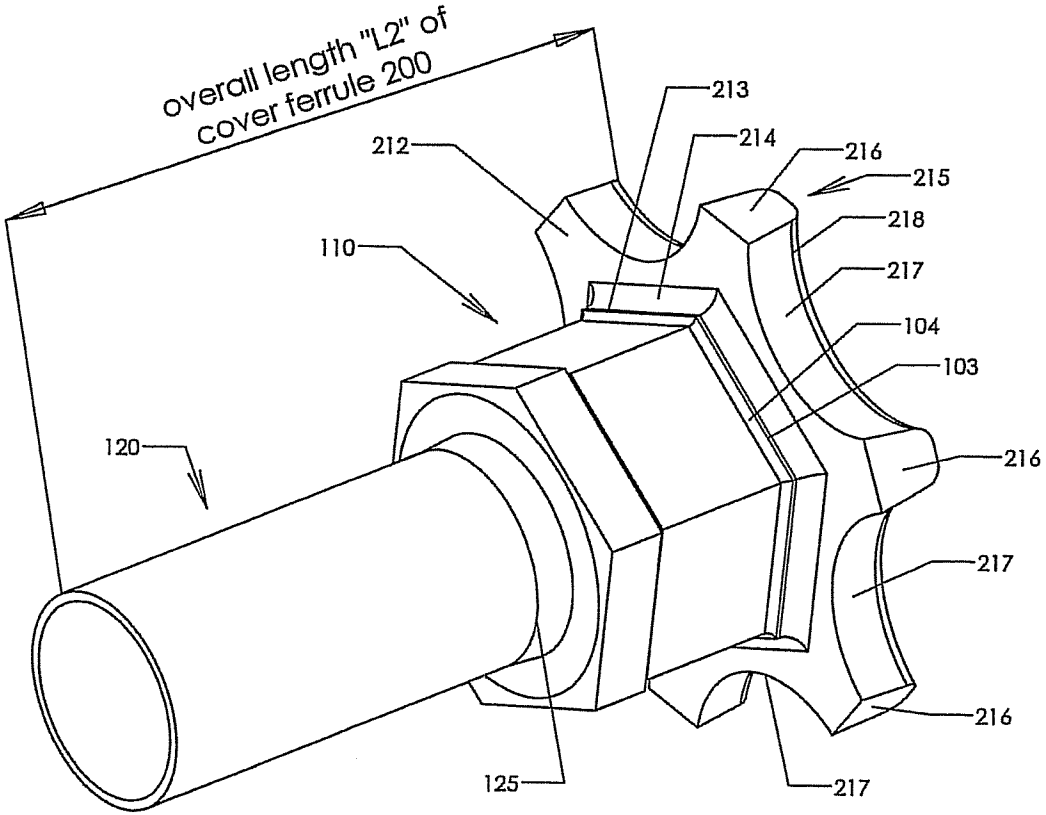
FIG. 7 is a perspective bottom view of the cover ferrule 200 shown in FIG. 6.

FIG. 6 shows a top perspective view of the cover ferrule 200 according to one aspect of the present invention, and FIG. 7 is a perspective bottom view of the cover ferrule 200 shown in FIG. 6.

The cover ferrule 200 includes a head portion 101 and a stem portion, 120, which have essentially the same structures as those described above in connection with the hex ferrule 100, and repeat descriptions of like reference numbers are omitted. In addition, the cover ferrule 200 also includes a joint shield portion 210 provided on the upper surface 102 of the head portion 101.

The joint shield portion 210 can be formed integrally or separately with respect to the head portion 101 and the stem portion 120, as described above. Moreover, it should be noted that the cover ferrule 200 can be made of the same materials and by the same methods described above in connection with the hex ferrule 100, despite the more complex nature of its shape, as any skilled artisan would readily appreciate.

The joint shield portion 210 includes an upper surface 211 and an opposed lower surface 212 which contacts/coincides with the upper surface 102 of the head portion 101 and which can be integrally formed therewith, as described above. This joint shield portion 210 can also be bonded, as a separately formed member, to the upper surfaces 102 of the head portions 101 of hex ferrules 100 in an exiting array using in situ mortar techniques, for example, in the event that a joint shield portion 210 needs to be added, repaired or replaced.

The joint shield portion 210 includes a central opening 219, coaxially aligned with respect to the central openings 109 and 129 of the head portion 101 and the stem portion 120, and with respect to the central axis of the cover ferrule 200. The opening 219 includes a tapered section 220, which is a lead-in section from the upper surface 211 to the inner surface 106 of the head portion 101 from which the joint shield portion 210 extends. Since the joint shield portion 210 defines the gas feed inlet, hotface of the array 400, the tapered surface 220 aids in guiding the directionality of the gas flow through the cover ferrules 200 within the array 400.

The joint shield portion 210 includes a plurality of extension members 215 extending radially outward with respect to the central axis of the cover ferrule and defining arc sections 217 connecting respectively adjacent extension members 215. In a preferred embodiment, the joint shield section 210 includes six extension members 215 connected by arc sections 217 each covering 120°. In addition, there is a tapered surface 218 provided between the upper surface 211 and the lower surface 212 of the arc sections 217 between the extension members 215, so as to guide the directionality of the gas flow through the joint shield section 210 and into the respective head portions 101 of adjacent hex ferrules 100 in the array 400. In that manner, the tapered surface 218 aids in providing a smooth overall gas flow into the array 400, as defined by the combination of hex ferrules 100 and cover ferrules 200.

The extension members 215 of the joint shield section 210 each include a flat end face 216 extending in a direction that is substantially perpendicular with respect to an upper surface 211 of the joint shield portion 210, and that is substantially parallel with respect to the central axis of the cover ferrule 200, whereby adjacent end faces 216 of extension members 215 from adjacent cover ferrules 200 in the array 400 face one another, and are separated only by a predetermined gap, on the order of 0.020"−0.060"+ or −0.005" cold, to accommodate for thermal expansion behavior when the industrial heat source is in an in operative state (in an inoperative state of the array 400), and so as to abut one another in a gas-tight manner when the industrial heat source is in an operative state (in an operative state of the array 400).

It is important to control the dimensions of the joint shield section 210 so as to provide a the predetermined gap so as to be at a specific distance between adjacent flat faces 216 of the respective extension members 215, because if the gap is too large, the thermal expansion behavior during operation will not account for the size, and the overall effectiveness of the cover ferrule array will be diminished. On the other hand, if the gap is too small, mechanical loads and stresses will be placed on the ferrules during operation, which is also undesirable.

The flat lower surfaces 212 of the extension members 215 of the joint shield section 210 contact the flat portions 103 of the upper surfaces 102 of the head portions 101 of the adjacent hex ferrules 100, so that the extension members 215 of the joint shield section 210 overlap a portion of the upper surfaces 102 of the respective head portions 101 of the hex ferrules 100 in the array 400. The arc portions 217 of the extension members 215 each circumscribe a portion, e.g. one-third, of the central openings 109 of the adjacent head portions 101 of the hex ferrules 100. In that manner, any gaps present between outer peripheral edges of respectively adjacent head portions 101 of the hex ferrules 100 in the array 400 are overlapped by the extension members 215.

As shown in FIGS. 8 and 9, the plurality of cover ferrules 200 are arranged among the plurality of hex ferrules 100 in the array 400, and the number "n" of the cover ferrules corresponds to a number "2n" of hex ferrules 100 in the array. As shown, the portion of the array 400 depicted includes fourteen hex ferrules 100, labeled 100(1)-100(14), and seven cover ferrules 200, labeled 200(1)-200(7). FIG. 9 also shows the cover ferrule 200(5) from FIG. 8 in an elevated state, to further clarify the arrangement and structure of the array 400. The cover ferrule 200(5) is surrounded by six hex ferrules—in particular, as shown in FIG. 8, hex ferrules 100(2), 100(3), 100(4), 100(6), 100(10), 100(9) and 100(7). In practice, it is conceivable to have up to as many as 2000 hex ferrules 100 and 1000 cover ferrules 200 in a tubesheet array of this nature, while an average tubesheet array can include 260 hex ferrules 100 and 130 cover ferrules 200.

As described above, the hex ferrules 100, cover ferrules 200, and the combination thereof in an array 400 according to the present invention accommodates variability in tubesheet tube to tube pitch, while preserving the function of the expansion gap between the ferrules in the array so as reduce/eliminate mechanical loading on the heads due to accumulated thermal expansion across the tubesheet, and provides effective containment of the head gasket material seated in the recess area along the head periphery.

What is claimed is:

1. A ferrule array including comprising:

a plurality of first ferrules, each of the first ferrules comprising a hexagonally shaped head portion having an upper surface including a flat portion circumscribing a central opening of the head portion, and a substantially cylindrical stem portion extending from a lower surface of the head portion and having a central opening therein, wherein the central openings of the head portion and the stem portion are coaxially aligned with respect to one another and a central axis of the first ferrules, to define a single continuous ferrule opening that passes through the first ferrule from an upper surface of the head portion to a lower surface of the stein portion thereof, wherein the plurality of first ferrules are arranged in a pattern to define an array; and a plurality of second ferrules, each of the second ferrules comprising a hexagonally shaped head portion, a substantially cylindrical stem portion extending from a lower surface of the head portion, a central opening that is coaxially aligned with respect to a central axis of the second ferrules and passing continuously therethrough from a central opening in an upper surface of the head portion to a central opening in a lower surface of the stem portion, and a joint shield portion provided at an upper surface of the head portion, the joint shield portion comprising a central opening, coaxially aligned with respect to the central openings of the head portion and the stem portion and with respect to the central axis of the second ferrule, and a plurality of extension members extending radially outward with respect to the central axis of the second ferrule and defining arcs connecting respectively adjacent extensions, wherein the plurality of second ferrules are arranged among the plurality of first ferrules in the array;

wherein a number "n" of the plurality of second ferrules corresponds to a number "2n" of the plurality of first ferrules in the array; and wherein lower surfaces of the extension members of the joint shield section of the second ferrules contact the flat portions of the upper surfaces of the head portions of the first ferrules in the array so that the extension members overlap a portion of the upper surfaces of the respective head portions of the first ferrules, whereby the arc portions of the extension members each circumscribe a portion of the central openings of the adjacent head portions of the first ferrules, and any gaps present between outer peripheral edges of respectively adjacent head portions of the first ferrules in the array are overlapped by the extension members.

2. The ferrule array according to claim 1, wherein the joint shield portion further comprises a tapered surface extending from an outer peripheral edge of the central opening toward the central axis of the second ferrules.

3. The ferrule array according to claim 1, wherein the joint shield portion includes six extension members, and the arcs connecting adjacent extension members are each 120°.

4. The ferrule array according to claim 1, wherein the extension members each comprise a flat end face extending in a direction that is substantially perpendicular with respect to an upper surface of the joint shield portion and that is substantially parallel with respect to the central axis of the second ferrule, whereby adjacent end faces of extension members from adjacent second ferrules in the array face one another, are separated only by a predetermined gap in an inoperative state of the array, and to abut one another in a gas-tight manner in an operative state of the array.

* * * * *

UNITED STATES PATENT AND TRADEMARK OFFICE

CERTIFICATE OF CORRECTION

PATENT NO. : 8,646,515 B2
APPLICATION NO. : 12/846939
DATED : February 11, 2014
INVENTOR(S) : Edwin L. Collins, III et al.

It is certified that error appears in the above-identified patent and that said Letters Patent is hereby corrected as shown below:

Title page, Item (57) Abstract - line 3

Please change: "stein" to -- stem --

Signed and Sealed this
Seventeenth Day of June, 2014

Michelle K. Lee

Michelle K. Lee
*Deputy Director of the United States Patent and Trademark Office*